United States Patent [19]

Mimoto et al.

[11] Patent Number: 4,695,745

[45] Date of Patent: Sep. 22, 1987

[54] MONOLITHIC SEMICONDUCTOR INTEGRATED CIRCUIT WITH PROGRAMMABLE ELEMENTS FOR MINIMIZING DEVIATION OF THRESHOLD VALUE

[75] Inventors: Toshio Mimoto, Nara; Keizo Sakiyama, Kashihara, both of Japan

[73] Assignee: Sharp Kabushiki Kaisha, Osaka, Japan

[21] Appl. No.: 681,588

[22] Filed: Dec. 14, 1984

[30] Foreign Application Priority Data

Dec. 17, 1983 [JP] Japan ..... 58-238407

[51] Int. Cl.[4] ..... G05F 3/16

[52] U.S. Cl. ..... 307/297; 307/200 B; 307/202.1; 307/296 R

[58] Field of Search ..... 307/200 A, 200 B, 202.1, 307/465, 468, 469, 296 R, 297, 304

[56] References Cited

U.S. PATENT DOCUMENTS

| | | | |
|---|---|---|---|
| 4,100,437 | 7/1978 | Hoff, Jr. | 307/297 |
| 4,229,667 | 10/1980 | Heimbigner et al. | 307/304 X |
| 4,322,675 | 3/1982 | Lee et al. | 307/200 B X |
| 4,435,652 | 3/1984 | Stevens | 307/297 |
| 4,593,203 | 6/1986 | Iwahashi et al. | 307/202.1 |

FOREIGN PATENT DOCUMENTS

| | | | |
|---|---|---|---|
| 0089031 | 5/1984 | Japan | 307/296 R |

OTHER PUBLICATIONS

Harroun, "Substrate Bias Voltage Control", IBM Tech. Disc. Bull., vol. 22, No. 7, Dec. 1979, pp. 2691-2692.

*Primary Examiner*—Stanley D. Miller
*Assistant Examiner*—D. R. Hudspeth
*Attorney, Agent, or Firm*—Birch, Stewart Kolasch & Birch

[57] ABSTRACT

An integrated circuit includes a plurality of threshold-value compensatory programmable elements integrally incorporated into a semiconductor integrated circuit, wherein, during the inspection process after assembly, the programmable elements store stationary data related to varied threshold voltages occurred during assembly process so that the varied substrate bias voltages can be restored to an ideal level by applying compensations as required. This circuit is extremely advantageous in that it effectively compensates for even the slightest variation of the threshold voltage in the integrated circuit using its extremely simplified circuit configuration, and in light of the conventional tendency in which redundant circuits containing a variety of chip parts each having a substantial area are used, against the needs for high-density part installation, the circuit embodied by the present invention effectively and securely provides means for realizing higher yield of monolithic semiconductor integrated circuits.

4 Claims, 5 Drawing Figures

MONOLITHIC SEMICONDUCTOR INTEGRATED CIRCUIT WITH PROGRAMMABLE ELEMENTS FOR MINIMIZING DEVIATION OF THRESHOLD VALUE

BACKGROUND OF THE INVENTION

The present invention relates to a MOS semiconductor integrated circuit incorporating a substrate bias voltage generator circuit, and more particularly, to such an integrated circuit that properly compensates for the threshold value after assembly process by controlling the substrate bias voltage using programmable elements.

Conventionally, a method available for connecting an output voltage from a substrate bias voltage generator circuit on the same MOS semiconductor integrated circuit to its own substrate not only provides MOS transistors with an optimum threshold value, but also makes it possible to gain a substantially extensive voltage operation margin by reducing the backgate effect, while ensuring satisfactory resistance against noise caused by the integrated circuit itself and by external input/output signals. In addition, such a method also provides a convenience for accelerating the operating speed of circuits due to reduced capacitance in the Pn junction portion. Reflecting these advantages, the above method has been widely used today. FIG. 5 shows one of the conventional substrate bias voltage generator circuits.

Reference number 1 indicates an oscillator circuit which causes the substrate bias voltage VBB to be generated by feeding its output signals $\phi$ to the charge pump circuit 2. Assuming that VT3 and VT4 respectively denote such threshold values by taking into consideration the possible backgate effect in respective MOS transistors 3 and 4 of the charge pump circuit 2 and VH also denotes the output voltage from the oscillator circuit, the ideal value of the substrate bias voltage output VBB is represented by VT3+VT4−VH. On the other hand, since a variety of processes are needed until MOS semiconductor integrated circuits are eventually formed on a substrate, the threshold value is unavoidably varied, and as a result, the greater the threshold value, the slower the circuit operation and the greater the difficulty in properly operating circuits using lowered voltages. Conversely, if the threshold value remains substantially low, it will cause the amount of current leakage from MOS transistors to increase. As a result, it is quite desirable to constrain such variation of the threshold value within a minimum range. Nevertheless, actually, there was no practical means for effectively compensating for such a variable threshold value inherent to any of the conventional semiconductor integrated circuit boards after completing assembly, thus an obstacle still exists against an urgent need for improving the actual yield of the assembled circuits.

OBJECT OF THE INVENTION

In light of such problems thus described in conjunction with conventional semiconductor integrated circuits, the present invention aims at providing such a monolithic semiconductor integrated circuit by effectively improving the substrate bias generator circuit so that it properly compensates for even the slightest variation and deviation of the threshold value as required. One of the preferred embodiments of the present invention integrally provides such a semiconductor integrated circuit incorporating a plurality of programmable elements, which correctly compensates for even the slightest variation and/or deviation of the threshold value occurring during the assembly process by properly controlling the substrate bias voltage using programmable elements storing the threshold value as stationary data by activating either electric signals or laser beams as required.

The preferred embodiments of the present invention securely provide means for effectively eliminating even the slightest variation or deviation of the threshold value taking place in any integrated circuit by introducing an extremely simple circuit configuration, and in addition, the preferred embodiments make it possible to securely realize a greatly improved yield of the assembled monolithic semiconductor integrated circuits for satisfying the industrial needs of today for using such redundant circuits containing programmable elements for better yield rate of modern integrated circuits containing high-density assembly of various chip parts each occupying a substantial area. In particular, the preferred embodiments of the present invention are ideally applicable to the substantial improvement of the yield rate and performance characteristics of a wide variety of high-density integrated circuit elements, and more particularly, for securely improving the yield rate and performance characteristics of memory elements, for example, 1M DRAM.

DETAILED DESCRIPTION OF THE PREFERRED EMBODIMENTS

Figure 1:
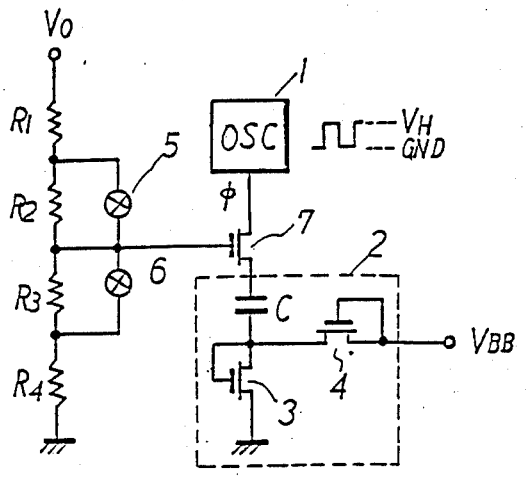
FIG. 1 is a simplified block diagram of a circuit reflecting the first preferred embodiment of the present invention.

FIG. 1 is a simplified block diagram of the substrate bias voltage generator circuit reflecting the first preferred embodiment of the present invention, in which a MOS transistor 7 is connected between the oscillator circuit 1 and the charge pump circuit 2, while a circuit capable of selecting an applicable voltage is connected to the gate of MOS transistor 7. The latter circuit is provided on the same substrate that mounts the main integrated circuit and contains such chip parts, for example, four-stage resistors R1 through R4 which are connected between the power voltage VO and the ground potential. Of these, resistors R2 and R3 are respectively connected in parallel to the programmable elements 5 and 6 made of polysilicon fuse or the like, while the gate of MOS transistor 7 is connected to the contact point connecting resistors R2 and R3. The programmable elements 5 and 6 normally remain conductive, whereas if it is necessary to adjust the gate voltage fed to MOS transistor 7, in other words, if the substrate bias voltage VBB output from the charge pump circuit 2 should be adjusted to a specific level by varying it either to a higher or lower level, then the conductive condition is erased by laser beams so that the non-conductive state can be stored. Assuming that VT7 denotes the threshold value by considering possible backgate effect of MOS transistor 7, the ideal value of the substrate bias voltage output VBB of such an integrated circuit containing the configuration described above can be calculated by a formula shown below.

$$VT3 + VT4 + VT7 - \frac{R4}{R1 + R4} \cdot V0$$

During the inspection of the assembled circuit boards, if it is found necessary to increase the threshold voltage of a MOS transistor of an integrated circuit, this can be effected by feeding a voltage which is lower than the substrate bias voltage VBB, and as a result, the conductive state of the programmable element 6 is cut off from the ground potential, thus eventually achieving the above object. In this case, the substrate bias voltage VBB can be denoted by a formula shown below.

$$VT3 + VT4 + VT7 - \frac{R3 + R4}{R1 + R3 + R4} \cdot V0$$

Conversely, if it is necessary to decrease the threshold value, this need can be sufficed by feeding a higher substrate bias voltage, which can be achieved by cutting off the conductive state of the programmable element 5 which is on the side of the power voltage VO.

In this case, the substrate bias voltage VBB can be denoted by a formula shown below.

$$VT3 + VT4 + VT7 - \frac{R4}{R1 + R2 + R4} \cdot V0$$

In summary, the substrate bias voltage VBB can be properly regulated by the pre-stored memory content of the programmable element, and as a result, even the slightest variation or deviation of the threshold value in MOS transistors of an integrated circuit can be properly compensated for.

Figure 2:
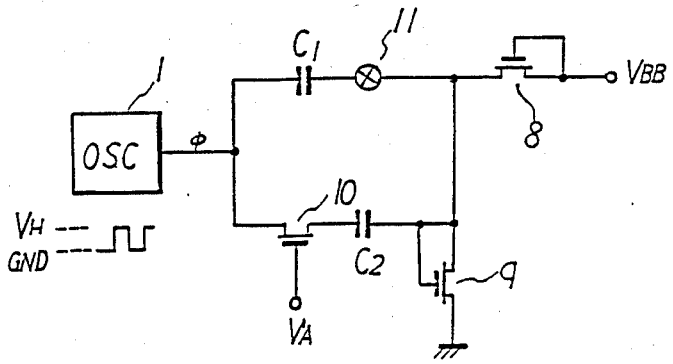
FIG. 2 is a simplified block diagram of a circuit reflecting the second preferred embodiment of the present invention.

FIG. 2 is the second preferred embodiment of the present invention. The charge pump circuit connected to the output signal $\phi$ of the oscillator circuit 1 is also connected to the programmable element 11 through capacitor C1 located between MOS transistor 8 and the output signal $\phi$, in which capacitor C1 and the programmable element 11 are connected in series to each other, while both of these are also connected to capacitor C2 and MOS transistor 10 which receives the gate voltage VA. In the substrate bias voltage generator circuit reflecting the second preferred embodiment, assuming that VT8, VT9, and VT10 respectively denote threshold values taking the backgate effect of MOS transistors into account, the ideal value of the substrate bias voltage VBB can be calculated by a formula VT8+VT9−VH. On the other hand, the substrate bias voltage VBB obtainable after cutting off the conductive state of the programmable element 11 is dependent on the gate voltage VA of MOS transistor 10, the value of which bias voltage can be calculated by a formula VT8+VT9+VT10−VA. In other words, the gate voltage VA can control the substrate bias voltage, thus eventually compensating for the threshold voltage.

Figure 3:
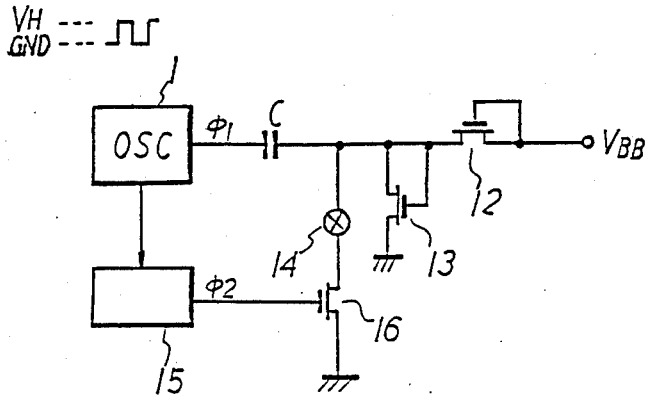
FIG. 3 is a simplified block diagram of a circuit reflecting the third preferred embodiment of the present invention.
Figure 4:
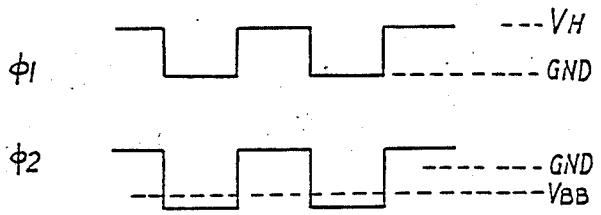
FIG. 4 is a timing chart showing the circuit operation of the third preferred embodiment of the present invention.
Figure 5:
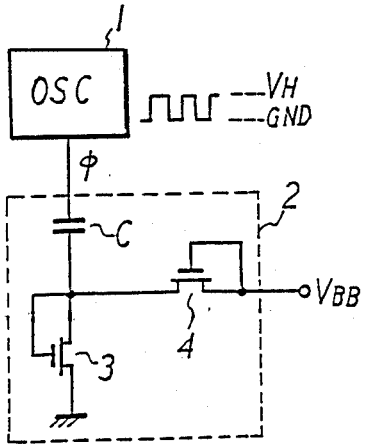
FIG. 5 PRIOR ART
FIG. 5 is a simplified block diagram of a conventional charge pump circuit.

FIG. 3 is a preferred embodiment applicable to a substrate bias voltage generator circuit dealing with high-power outputs. Reference numbers 12 and 13 respectively indicate MOS transistors comprising the charge pump circuit. In this circuit configuration, VT12 and VT13 denote threshold voltages with possible backgate effect taken into consideration. A serial circuit composed of the programmable element 14 and MOS transistor 16 is connected in parallel to MOS transistor 13 of the charge pump circuit. Signal $\phi$2 controlling the gate of MOS transistor 16 is sent out of the output terminal $\phi$ of the oscillation circuit through a control circuit 15. FIG. 4 is the timing chart showing the timing of signals $\phi$1 and $\phi$2 entering into the charge pump circuit. The ideal value of the substrate bias voltage VBB while the programmable element 14 of the charge pump circuit remains conductive is denoted by the formula VT12−VH. Conversely, if the programmable element 14 is cut off, substrate bias voltage VBB is denoted by the formula VT12+VT13−VH, thus allowing the substrate bias voltage VBB to be properly adjusted in reference to the memory element of the programmable elements.

What is claimed is:

1. A monolithic semiconductor integrated circuit comprising:

a substrate bias voltage generator circuit including, an oscillator circuit and a charge pump circuit;

MOS transistor means connecting said oscillator circuit to said charge pump circuit; and a plurality of programmable elements for permanently storing data being provided in a gate voltage circuit of said MOS transistor means to vary the voltage applied to the charge pump circuit in response to the memory content of said programmable elements.

2. A monolithic semiconductor integrated circuit comprising:

a substrate bias voltage generator circuit including, an oscillator circuit and a charge pump circuit;

gate-voltage-variable MOS transistor means selectively connected to said oscillator circuit and to said charge pump circuit; and at least one programmable element being connected in said bias voltage generator circuit in such a manner to selectively connect said gate voltage variable MOS transistor means to the charge pump circuit.

3. The monolithic semiconductor integrated circuit of claim 2, wherein said gate-voltage-variable MOS transistor means and said at least one programmable element are connected in parallel circuit branches in series with said oscillator circuit and said charge pump circuit.

4. The monolithic semiconductor integrated circuit of claim 2, wherein said charge pump circuit includes at least one MOS transistor, said gate-voltage-variable MOS transistor means is connected in series with said at least one programmable element, said series connection being connected in parallel with said at least one MOS transistor of said charge pump circuit.

* * * * *